US008152566B1

(12) United States Patent
Little et al.

(10) Patent No.: US 8,152,566 B1
(45) Date of Patent: Apr. 10, 2012

(54) ELECTRICAL CONNECTOR WITH RESILIENT ARM CONFIGURED IN FIXED ENDED BEAM MANNER FORMED ON METAL SHELL

(75) Inventors: Terrance F. Little, York, PA (US); Hung-Yang Yeh, New Taipei (TW); Yi-Guo Qi, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/028,247

(22) Filed: Feb. 16, 2011

(51) Int. Cl.
*H01R 9/03* (2006.01)

(52) U.S. Cl. ..... 439/607.41

(58) Field of Classification Search ..... 439/607.41, 439/352, 345, 626, 357, 449, 578–581, 660
See application file for complete search history.

(56) References Cited

U.S. PATENT DOCUMENTS 6,358,088 B1 3/2002 Nishio et al.
7,530,844 B2 * 5/2009 Shen ..... 439/598
7,632,155 B1 * 12/2009 Wu ..... 439/660
7,824,222 B2 11/2010 Miyoshi et al.
7,972,172 B2 * 7/2011 Huang et al. ..... 439/578
2008/0176441 A1 * 7/2008 Shen et al. ..... 439/352
2009/0298339 A1 * 12/2009 Wu ..... 439/607.41
2010/0062642 A1 * 3/2010 Zhang et al. ..... 439/607.41
2011/0195593 A1 * 8/2011 McGrath et al. ..... 439/345

* cited by examiner

*Primary Examiner* — Jean F Duverne

(74) *Attorney, Agent, or Firm* — Ming Chieh Chang; Wei Te Chung; Andrew C. Cheng

(57) ABSTRACT

An electrical connector includes an insulative housing, a number of contacts retained in the insulative housing and a metal shell enclosing the insulative housing. The metal shell includes a top wall, a bottom wall and a pair of side walls connecting the top wall and the bottom wall to jointly form a receiving space to accommodate the insulative housing. The top wall includes a resilient arm having two fixed distal ends and a locking protrusion located between the two fixed distal ends. The locking protrusion extends beyond a top surface of the top wall for deformably locking with a notch of a mateable connector. The resilient arm is configured in a fixed ended beam manner so as to achieve suitable flexibility and rigidity.

12 Claims, 11 Drawing Sheets

ELECTRICAL CONNECTOR WITH RESILIENT ARM CONFIGURED IN FIXED ENDED BEAM MANNER FORMED ON METAL SHELL

BACKGROUND OF THE INVENTION

1. Field of the Invention

The present invention relates to an electrical connector, and more particularly to an electrical connector with resilient beams formed on a metal shell for locking with a mateable connector. The instant application relates to related applications titled "ELECTRICAL CONNECTOR WITH IMPROVED LOCKING PROTRUSION INTEGRALLY FORMED ON METAL SHELL" and "ELECTRICAL CONNECTOR WITH CANTILEVERED ARM INTEGRALLY FORMED ON METAL SHELL", respectively, and having the at least one same applicant and the same assignee therewith.

2. Description of Related Art

Micro-USB connectors, including receptacle connectors and plug connectors, are usually used as a standard power charging port or a standard data transmission port in mobile devices. U.S. Pat. No. 7,824,222 B2 issued to Miyoshi et al. on Nov. 2, 2010 discloses such an electrical plug connector including an insulative housing, a plurality of contacts fixed on the insulative housing, a pair of locking members retained on the insulative housing and located at lateral sides of the contacts, and top and bottom metal covers jointly enclosing the insulative housing. The insulative housing defines a pair of slots for accommodating movement of the locking members. Each locking member includes a retaining portion fixed in the insulative housing, a cantilevered beam extending forwardly from the retaining portion, and a hook formed on the distal end of the cantilevered beam. Each hook extends upwardly through a cutout of the top metal cover for locking with a complementary metal shell of a receptacle connector.

However, since the locking members are separately made, an additional assembly process for mounting the locking member to the insulative housing is required, which will increase the costs of the plug connector. Moreover, with the trend that the transmission speed of connectors becomes more and more faster, the contact density in the connectors is getting higher. Under this situation, there will be no extra space on the insulative housing for mounting the locking members.

Hence, an electrical connector having improved resilient arms integrally formed on a metal shell with suitable flexibility and rigidity is desired.

BRIEF SUMMARY OF THE INVENTION

The present invention provides an electrical connector including an insulative housing, a plurality of contacts retained in the insulative housing and a metal shell enclosing the insulative housing. The metal shell includes a top wall, a bottom wall, and a pair of side walls connecting the top wall and the bottom wall to jointly form a receiving space to accommodate the insulative housing. The top wall includes a resilient arm configured in a fixed ended beam manner to achieve suitable flexibility and rigidity. The resilient arm is integrally formed with the top wall and includes two fixed distal ends and a locking protrusion located between the two fixed distal ends. The locking protrusion extends beyond a top surface of the top wall for deformably locking with a notch of a mateable connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
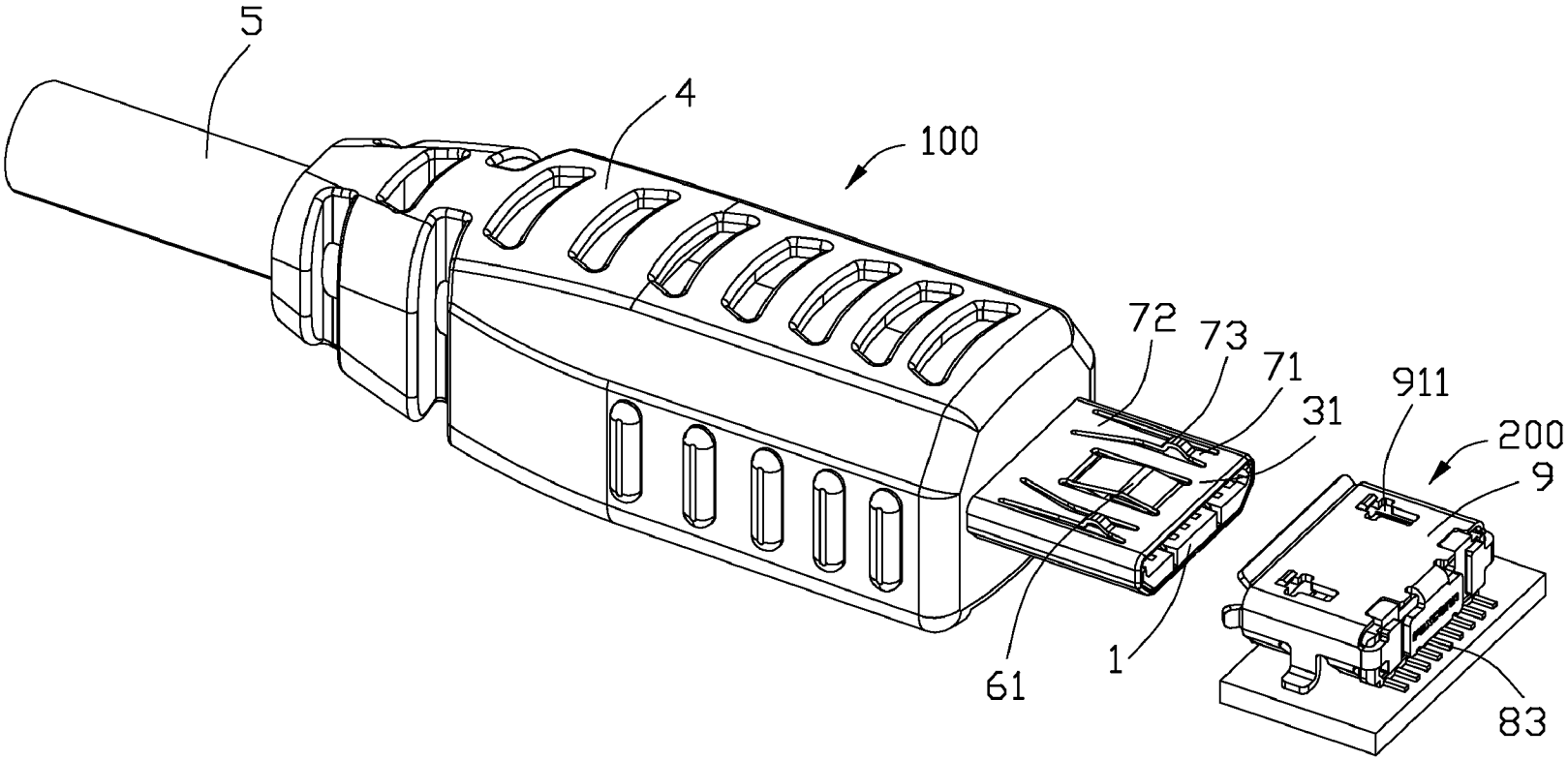
FIG. 1 is a perspective view of a connector assembly including a receptacle connector and a plug connector prior to be inserted into the receptacle connector in accordance with a preferred embodiment of the present invention.
Figure 2:
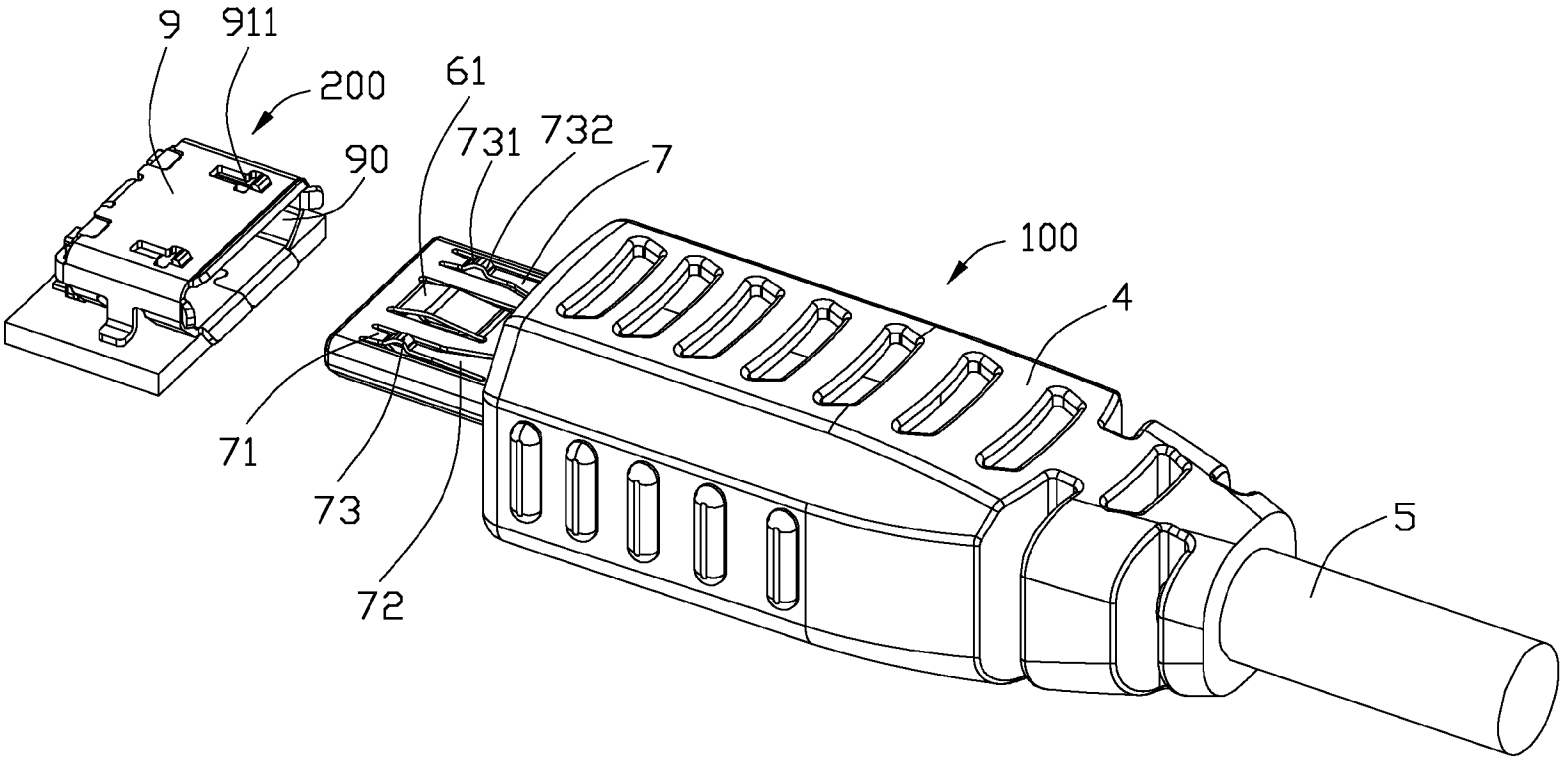
FIG. 2 is a perspective view of the connector assembly as shown in FIG. 1, taken from another aspect.
Figure 9:
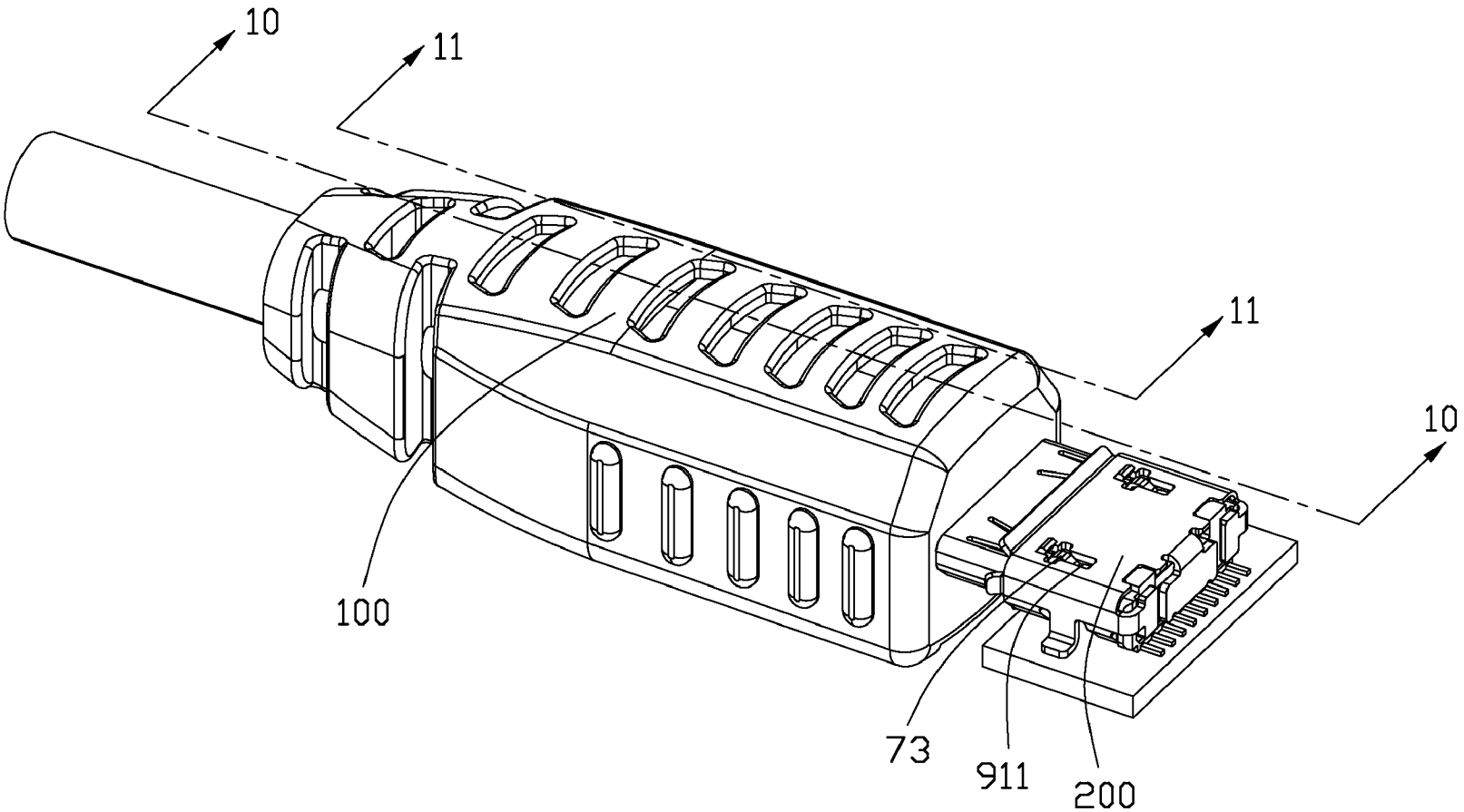
FIG. 9 is a perspective view of the connector assembly with the plug connector inserted into the receptacle connector.

Reference will now be made to the drawing figures to describe the preferred embodiment of the present invention in detail. FIGS. 1, 2 and 9 illustrate a connector assembly including a plug connector 100 and a receptacle connector 200 mateable with the plug connector 100. According to the illustrated embodiment of the present invention, the plug connector 100 and the receptacle connector 200 are compatible to Micro USB specification revision 1.01 released by USB-IF.

Figure 3:
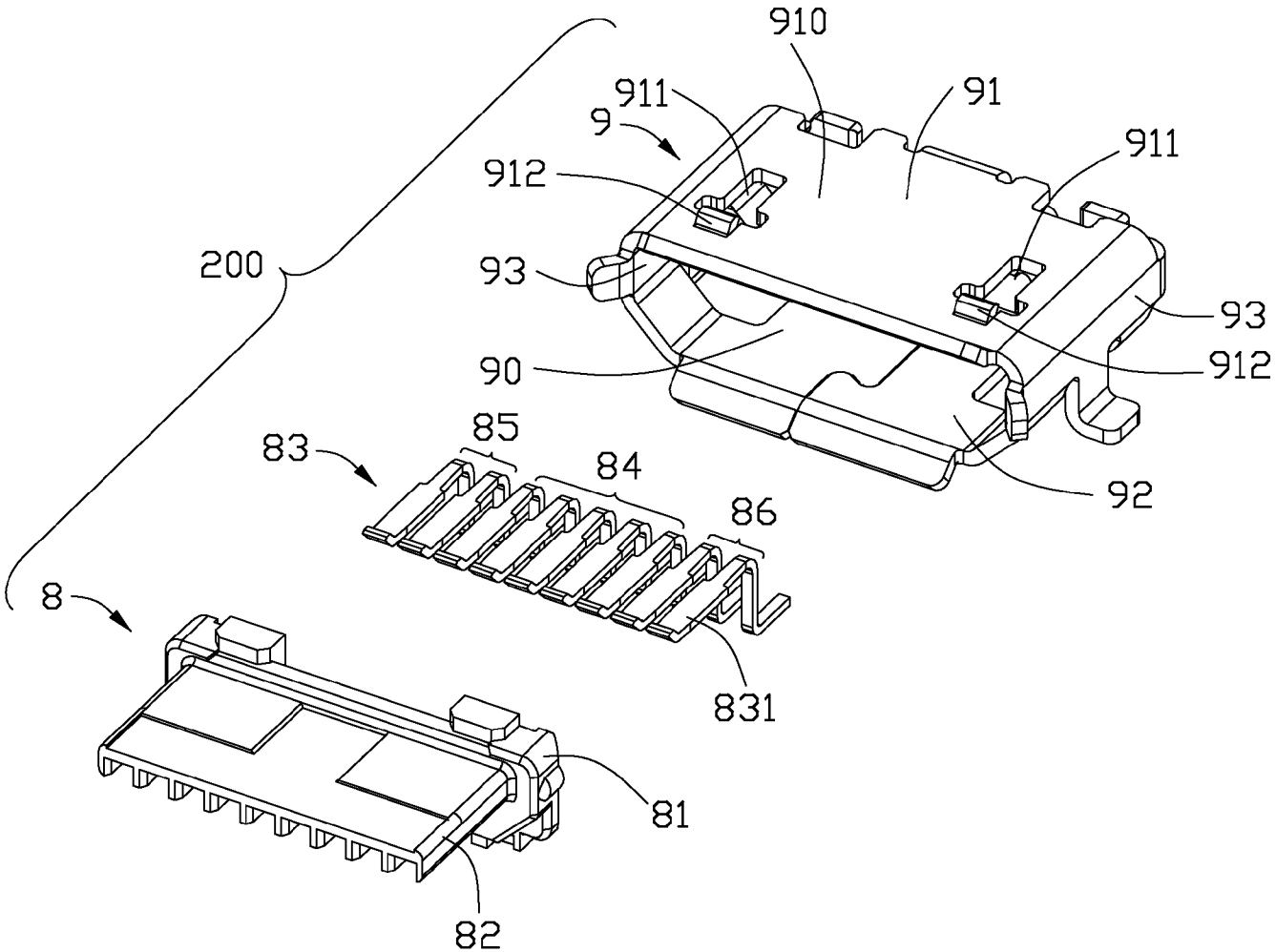
FIG. 3 is an exploded view of the receptacle connector.

Referring to FIG. 3, the receptacle connector 200 includes a receptacle housing 8 and a metal shield 9 enclosing the receptacle housing 8. The receptacle housing 8 includes a base 81 and a tongue plate 82 extending from the base 81. The metal shield 9 includes a top wall 91, a bottom wall 92 and a pair of side walls 93 which are jointly with the top wall 91 and the bottom wall 92 to define a plug-receiving cavity 90 enclosing the tongue plate 82. The top wall 91 defines a pair of T-shaped notches 911 communicating with the plug-receiving cavity 90 and a pair of reinforce blocks 912 at one end of the corresponding notches 911. Each reinforce block 912 is stamped from the top wall 91 to extend beyond a top surface 910 of the top wall 91. Besides, a plurality of receptacle contacts 83 are mounted on the tongue plate 82 and include five receptacle-type contacts 84 compatible to Micro-USB specification revision 1.01 and two pairs of additional contacts 85, 86 located at lateral sides of the receptacle-type contacts 84. Each receptacle contact 83 includes a flat contacting portion 831 exposed to the plug-receiving cavity 90.

Figure 4:
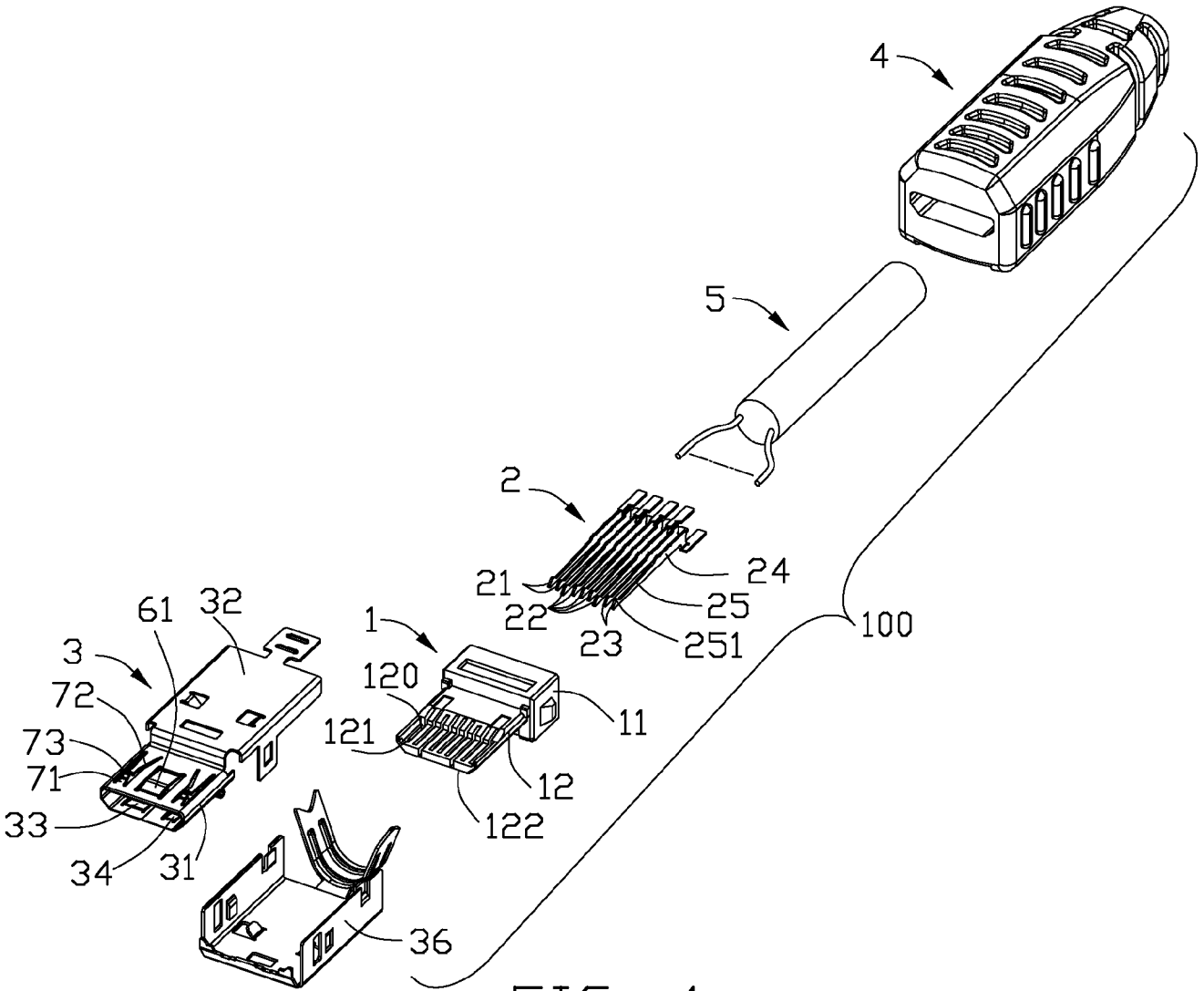
FIG. 4 is an exploded view of the plug connector.
Figure 5:
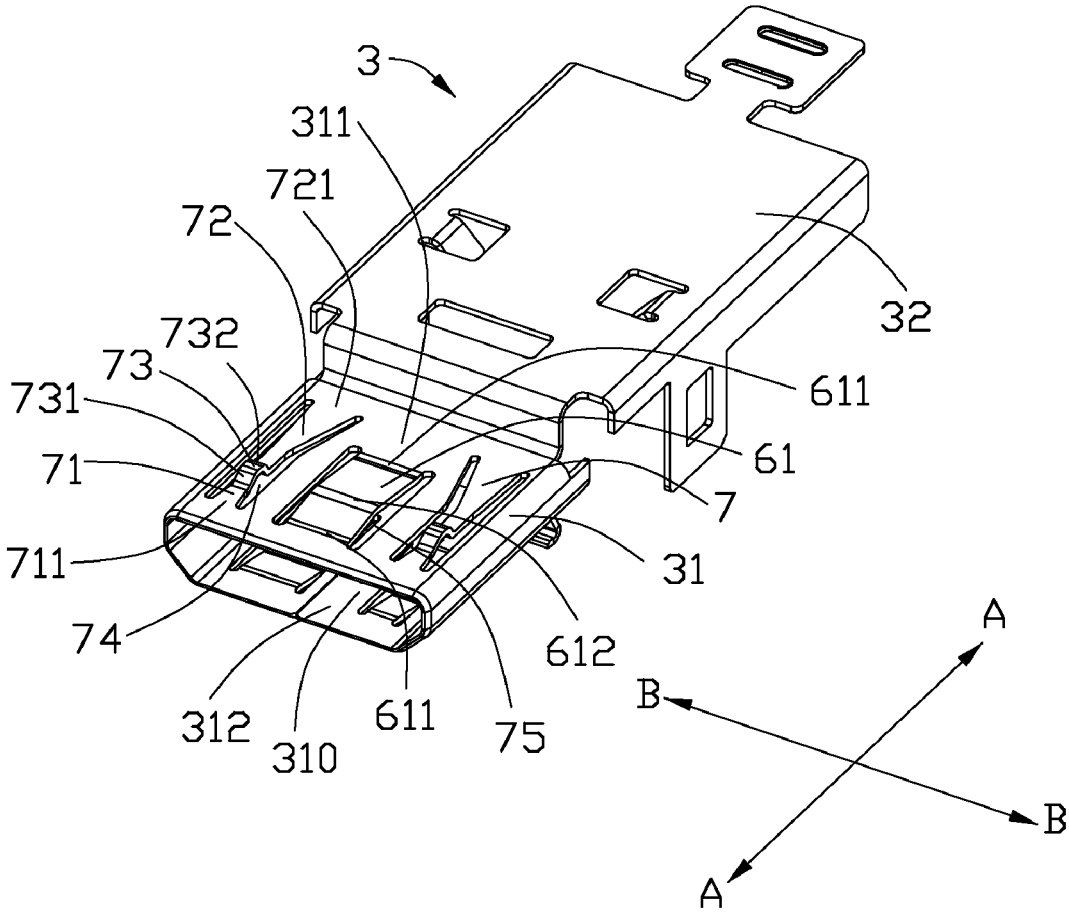
FIG. 5 is a perspective view of a metal shell of the plug connector.
Figure 6:
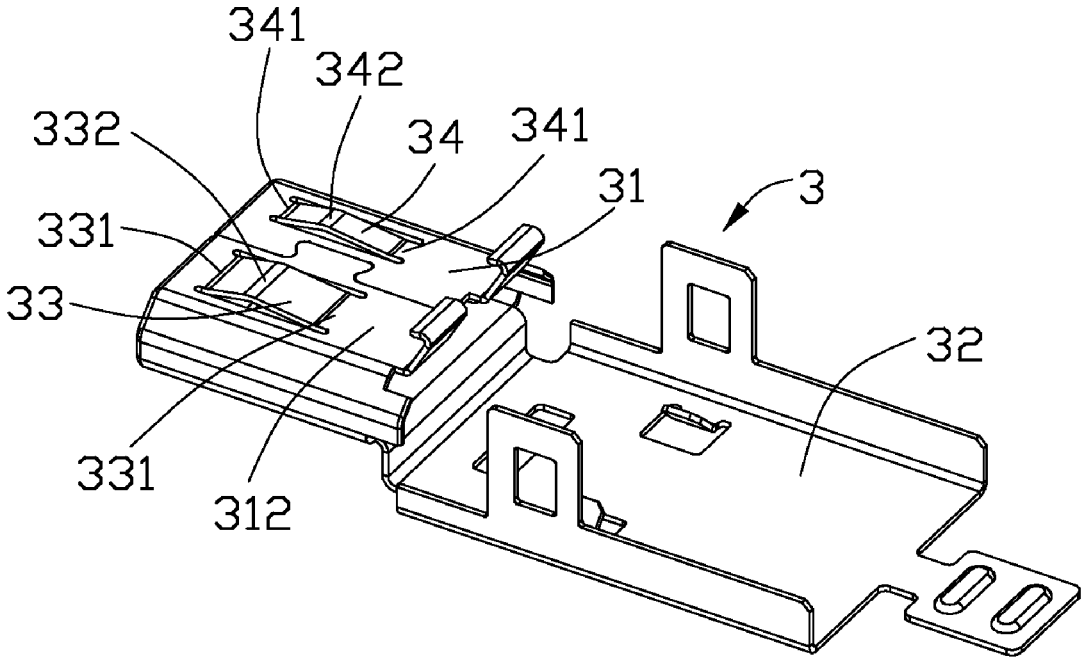
FIG. 6 is another perspective view of the metal shell as shown in FIG. 5, taken from another aspect.
Figure 7:
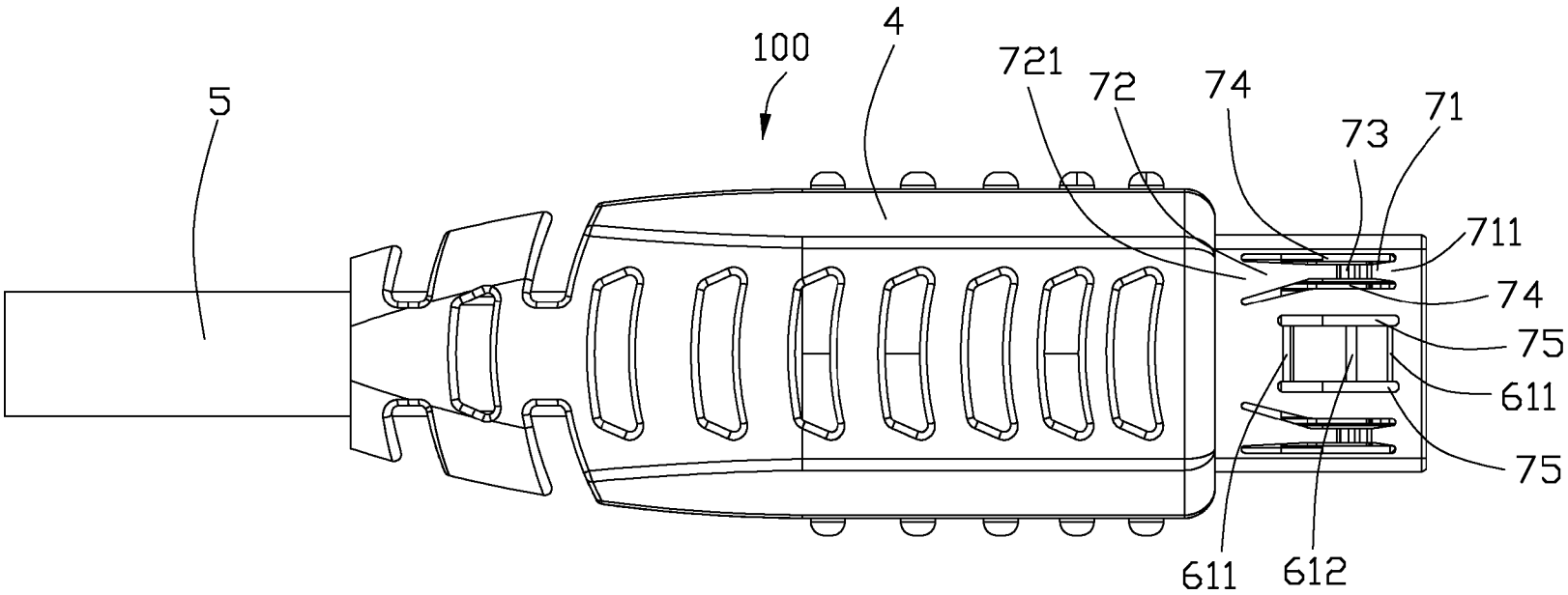
FIG. 7 is a top view of the plug connector as shown in FIG. 1.
Figure 8:
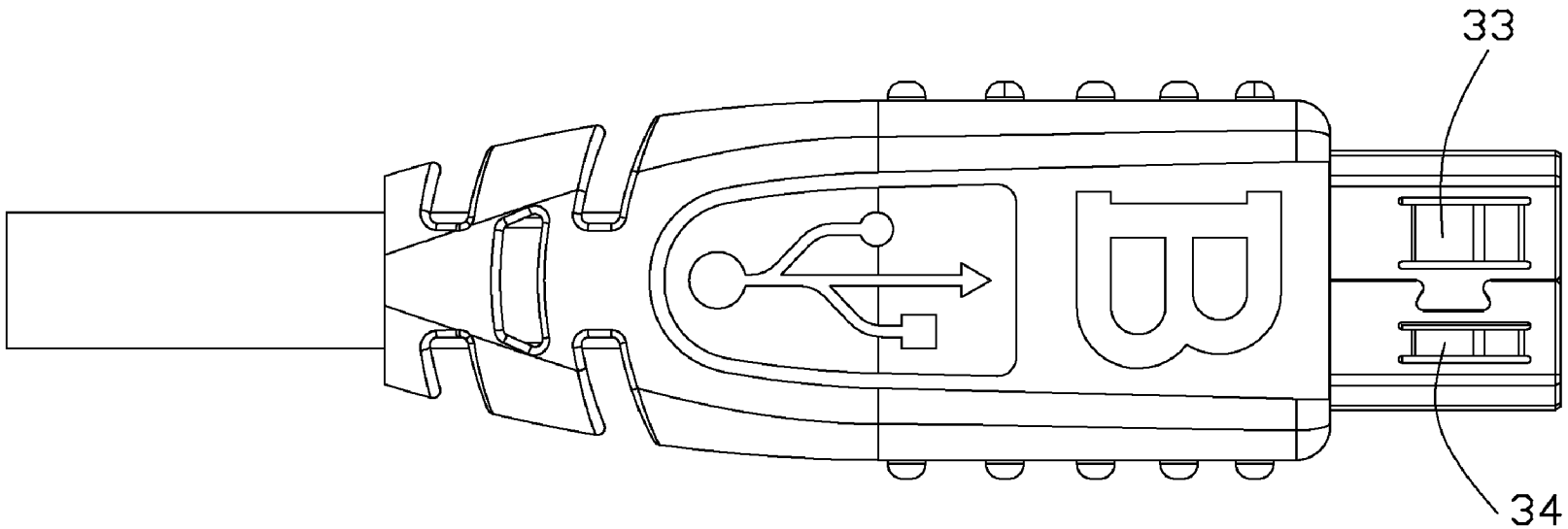
FIG. 8 is a bottom view of the plug connector as shown in FIG. 1.

Referring to FIG. 4, the plug connector 100 includes an insulative housing 1, a plurality of contacts 2 retained in the insulative housing 1, a metal shell 3 enclosing part of the insulative housing 1, a bottom shell 36 attached to the metal shell 3, an outer housing 4 over-molding the metal shell 3 and the bottom shell 36, and a plurality of cables 5 electrically connected with the corresponding contacts 2.

The insulative housing 1 includes a base portion 11 and a tongue portion 12 extending from the base portion 11. The tongue portion 12 includes a mating surface 121, a bottom surface 122 opposite to the mating surface 121 and a plurality of contact-receiving slots 120 recessed from the mating surface 121. The contact-receiving slots 120 further extend through the base portion 11 for receiving the contacts 2.

The contacts 2 include five plug-type contacts 21 compatible to Micro-USB specification revision 1.01 and two pairs of additional contacts 22, 23 located at lateral sides of the plug-type contacts 21. The additional contacts 22, 23 occupy the remainder space of the tongue portion 12 besides the plug-type contacts 21. With arrangement of the additional contacts 22, 23, transmission speed of the plug connector 100 is greatly improved. Each contact 2 includes a fixing portion 24 fixed to the base portion 11, a cable end portion (not labeled) extending backwardly from the fixing portion 24 for being connected the cables 5, and an elastic arm 25 extending forwardly from the fixing portion 24. The elastic arm 25 is cantilevered and includes a tapered contacting section 251 formed at the distal end thereof. The contacting section 251 protrudes beyond the mating surface 121 of the tongue portion 12. The elastic arm 25 is deformable in the corresponding contact-receiving slot 120 when the plug connector 100 is inserted into the receptacle connector 200.

Referring to FIGS. 5 to 8, the metal shell 3 includes a front tube portion 31 and an extension 32 extending backwardly from the front tube portion 31. The extension 32 is higher than the front tube portion 31 to be a step manner. The front tube portion 31 includes a top wall 311, a bottom wall 312, and a pair of side walls 313 connecting the top wall 311 and the bottom wall 312 to jointly form a receiving space 310 to accommodate the tongue portion 12 of the insulative housing 1. The top wall 311 includes a first engaging arm 61 located at an intermediate position thereof and a pair of resilient arms 7 located at opposite lateral sides of the first engaging arm 61. The pair of resilient arms 7 are symmetrical with each other along a middle plane therebetween. Since the pair of resilient arms 7 are similar in configuration, only one of them will be detailedly described hereinafter for simplicity.

Each resilient arm 7 is integrally stamped from the metal shell 3 for saving assembly costs, and each resilient arm 7 is in a fixed ended beam manner for achieving suitable flexibility and rigidity. Each resilient arm 7 includes a first arm 71 having a first distal end 711, a second arm 72 having a second distal end 721, and a locking protrusion 73 bridging the first and the second arms 71, 72. The locking protrusion 73 is located between the two fixed distal ends 711, 721 and extends beyond a top surface of the top wall 311 for deformably locking with the receptacle connector 200. The first and the second arms 71, 72 extend along opposite directions parallel to a mating direction A-A. The second distal end 721 is wider than the first distal end 711 along a transverse direction B-B perpendicular to the mating direction A-A. Either the first distal end 711 or the second distal end 721 are wider than the locking protrusion 73 so that bases of the first and the second arms 71, 72 are stable for not being easily broken after longtime use.

The locking protrusion 73 includes a first slant portion 731 connected to the first arm 71 and a second slant portion 732 connected to the second arm 72. The second arm 72 is longer than the first arm 71. A slope of the first slant portion 731 is smaller than that of the second slant portion 732 so that the first slat portion 731 is more suitable as a guiding member for guiding insertion of the plug connector 100 into the receptacle connector 200, and the second slant portion 731 is more suitable as a locking member for abutting against the receptacle connector 200.

A pair of first slits 74 are formed on the top wall 31 to encompass each resilient arm 7 so that each resilient arm 7 is provided with robust deformablity. Similarly, a pair of second slits 75 are formed on the top wall to encompass the first engaging arm 61 which is wider than each resilient arm 7 along the transverse direction B-B. The first engaging arm 61 is in a fixed ended beam manner as well and includes a pair of first fixed ends 611 and a first protrusion 612 located between the first fixed ends 611. The first protrusion 612 extends beyond the top surface of the top wall 31 for abutting against the top wall 91 of the receptacle connector 200 in order to increase friction force.

The bottom wall 312 includes a second engaging arm 33 and a third engaging arm 34 separated a distance along the transverse direction B-B with respect to the second engaging arm 33. The second engaging arm 33 and the third engaging arm 34 are both in a fixed ended beam manners similar to the first engaging arm 61. The second engaging arm 33 is offset from and narrower than the first engaging arm 61. The third engaging arm 34 is located under one of the resilient arms 7 and narrower than the second engaging arm 33. The second engaging arm 33 includes a pair of second fixed ends 331 and a second protrusion 332 located between the second fixed ends 331. The third engaging arm 34 includes a pair of third fixed ends 341 and a third protrusion 342 located between the third fixed ends 341. The second and the third protrusions 332, 342 both extend beyond a bottom surface of the bottom wall 312 for abutting against the bottom wall 92 of the receptacle connector 200 to increase friction force.

Figure 10:
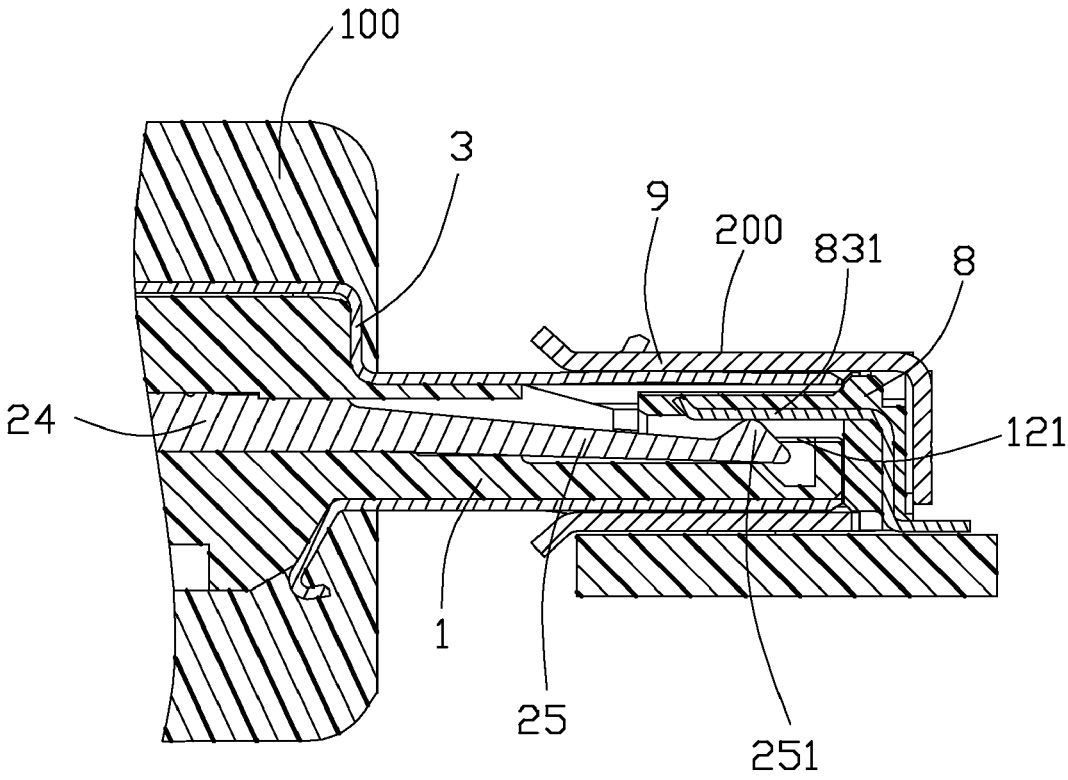
FIG. 10 is a cross-sectional view of the connector assembly taken along line 10-10 in FIG. 9 showing receptacle contacts and plug contacts mateable with each other.
Figure 11:
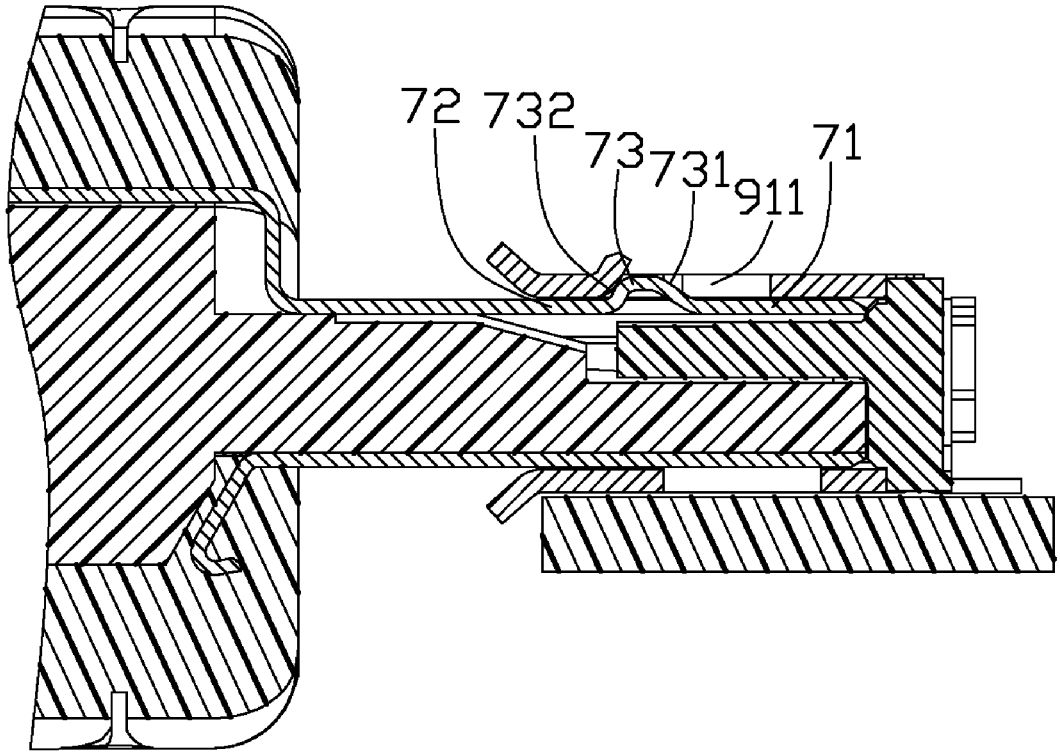
FIG. 11 is another cross-sectional view of the connector assembly taken along line 11-11 in FIG. 9 showing locking protrusions of the plug connector protruding into notches of the receptacle connector.

Referring to FIGS. 9-11, when the plug connector 100 is inserted into the plug-receiving cavity 90 of the receptacle connector 200, the first slant portion 731 of each locking protrusion 73 is abutted against the metal shield 9 to press the resilient arm 7. After the first slant portion 731 overcomes the friction to reach the notch 911, the resilient arm 7 releases its elasticity so that the second slant portion 732 locks with the notch 911. Under this condition, the tapered contacting sections 251 of the contacts 2 abut against the flat contacting portions 831 of the receptacle contacts 83. The first, the second and the third engaging arms 61, 33 and 34 press inner surfaces of the metal shield 9 to keep the plug connector 100 reside in the receptacle connector 200.

When the plug connector 100 is removed from the plug-receiving cavity 90 of the receptacle connector 200, the second slant portion 732 of each locking protrusion 73 is abutted against the metal shield 9 to deform the second arm 72. The first, the second and the third engaging arms 61, 33 and 34 withdraw from the metal shield 9 ultimately. The resilient arm 7 in a fixed ended manner is provided with suitable flexibility and rigidity during inserting the plug connector 100 into the receptacle connector 200 or withdrawing the plug connector 100 from the receptacle connector 200. It is noted that compared with the conventional cantilevered type resilient arm with the hook at the free end, in the instant invention the fixed ended type resilient arm with the hook structure located at an asymmetric position between the two opposite fixed ends, performs different but superior mechanical effects among the shear strength or the bending moment fields. On the other hand, it is noted that different from the conventional cantilevered resilient beam which is directly stamped from sheet metal and has one end fixed to the housing, in the instant invention the (dual) fixed ended type resilient arm is initially blanked from the metal shell 3 with two opposite ends unitarily linked with corresponding two opposite edges of the corresponding opening, and is further formed with an upward protrusion via ductility/malleability of metal, thus, manufacturability thereof being also different.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing;

a plurality of contacts retained in the insulative housing; and a metal shell enclosing the insulative housing and comprising a top wall, a bottom wall, and a pair of side walls connecting the top wall and the bottom wall to jointly form a receiving space to accommodate the insulative housing, the top wall comprising an integral resilient arm configured in a fixed ended beam manner, the resilient arm comprising two fixed distal ends and a locking protrusion located between the two fixed distal ends, the locking protrusion extending beyond a top surface of the top wall for deformably locking with a notch of a mateable connector; wherein the top wall comprises a first engaging arm in a fixed ended beam manner, the first engaging arm comprising a pair of first fixed ends and a first protrusion located between the first fixed ends, the first protrusion extending beyond the top surface of the top wall for abutting against the mateable connector; wherein the bottom wall comprises a second engaging arm in a fixed ended beam manner, the second engaging arm comprising a pair of second fixed ends and a second protrusion located between the second fixed ends, the second protrusion extending beyond a bottom surface of the bottom wall, the second engaging arm being offset from and being narrower than the first engaging arm; wherein the bottom wall comprises a third engaging arm in a fixed ended beam manner, the third engaging arm comprising a pair of third fixed ends and a third protrusion located between the third fixed ends, the third protrusion extending beyond the bottom surface of the bottom wall, the third engaging arm being narrower than the second engaging arm while being wider than the locking protrusion.

2. The electrical connector as claimed in claim 1, wherein the two fixed distal ends comprise a first end and a second end, the resilient arm comprising a first arm containing the first end and a second arm containing the second end, the first arm and the second arm being connected with each other.

3. The electrical connector as claimed in claim 2, wherein the second arm is longer than the first arm along a mating direction.

4. The electrical connector as claimed in claim 3, wherein the second end is wider than the first end along a transverse direction perpendicular to the mating direction.

5. The electrical connector as claimed in claim 2, wherein one of the first end and the second end is wider than the locking protrusion.

6. The electrical connector as claimed in claim 2, wherein the locking protrusion comprises a first slant portion connected to the first arm, and a second slant portion connected to the second arm, a slope of the first slant portion being smaller than that of the second slant portion.

7. The electrical connector as claimed in claim 1, wherein the top wall further comprises another resilient arm which is symmetrical to the resilient arm along a transverse direction.

8. The electrical connector as claimed in claim 1, wherein the first protrusion is wider than the resilient arms.

9. An electrical plug comprising:

an insulative housing;

a plurality of contacts with contacting sections extending beyond the insulative housing; and a metal shell enclosing the insulative housing and comprising a top wall, a bottom wall, and a pair of side walls connecting the top wall and the bottom wall to jointly form a receiving space to accommodate the insulative housing, the contacting sections protruding into the receiving space, the top wall comprising a resilient arm which includes a first arm, a second arm and a locking protrusion connecting the first arm and the second arm, the locking protrusion extending beyond a top surface of the top wall for deformably locking with a mateable connector, the second arm being longer than the first arm along a mating direction; wherein the resilient arm comprises a first end and a second end on the first arm and the second arm, respectively, the second end being wider than the first end along a transverse direction perpendicular to the mating direction; wherein the locking protrusion comprises a first slant portion connected to the first arm and a second slant portion connected to the second arm, a slope of the first slant portion being smaller than that of the second slant portion.

10. The electrical plug as claimed in claim 9, wherein the top wall and the bottom wall each comprise at least one engaging arm configured in a fixed ended beam manner, the at least one engaging arm comprising a pair of fixed ends and a protrusion located between the fixed ends, the protrusion extending beyond a corresponding one of the top and the bottom walls for abutting against the mateable connector.

11. An electrical connector assembly comprising:

a plug connector including:

an insulative plug housing defining a plug mating port;

a plurality of plug contacts disposed in the housing with contacting sections exposed in the plug mating port;

a metallic plug shell enclosing the plug housing including the plug mating port, said plug shell defining a wall, at least one opening defined in the wall, a resilient arm unitarily formed with the wall with thereof two opposite ends unitarily extending from two opposite edge regions of the opening along a mating direction, said resilient arm further defining unitarily an outwardly projecting hooked structure located between said two opposite ends and adapted for locking a receptacle connector; wherein a thickness of the hooked structure is essentially less than that of remaining portions of the resilient arm; wherein said hooked structure is asymmetrically located between said two opposite ends; wherein the resilient arm defines a larger width around one end which is farther from the hooked structure than the other end; wherein said receptacle connector defines an insulative receptacle housing with a plurality of receptacle contacts therein and a metallic receptacle shell enclosing said receptacle housing, and during mating, said receptacle shell encloses the mating port and the plug shell thereon, under condition that said receptacle shell defines a through hole into which said hooked structure is received.

12. The electrical connector assembly as claimed in claim 11, wherein said through hole defines a cross like configuration, and an apex of said hooked structure is essentially located at an intersection region of said cross like configuration.

* * * * *